US006512436B2

(12) United States Patent
Igarashi et al.

(10) Patent No.: US 6,512,436 B2
(45) Date of Patent: Jan. 28, 2003

(54) ELECTROMAGNETIC ACTUATOR

(75) Inventors: Hiroshi Igarashi, Wako (JP); Hiroshi Kuribayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/736,493

(22) Filed: Dec. 13, 2000

(65) Prior Publication Data

US 2002/0050900 A1 May 2, 2002

(30) Foreign Application Priority Data

Dec. 22, 1999 (JP) ..... 11-363656

(51) Int. Cl.[7] ..... F02M 51/06; H01F 3/00; H01F 7/08

(52) U.S. Cl. ..... 335/281; 239/585.1

(58) Field of Search ..... 335/255, 261, 335/262, 263, 270, 274, 281; 239/585.1–585.5

(56) References Cited

U.S. PATENT DOCUMENTS

| | | | | | |
|---|---|---|---|---|---|
| 3,900,822 | A | * | 8/1975 | Hardwick et al. | 335/268 |
| 4,218,669 | A | * | 8/1980 | Hitchcock et al. | 251/129.14 |
| 5,626,327 | A | * | 5/1997 | Clark | 251/129.15 |
| 6,032,879 | A | * | 3/2000 | Hamada et al. | 239/585.1 |
| 6,062,499 | A | * | 5/2000 | Nakamura et al. | 239/585.1 |
| 6,125,803 | A | * | 10/2000 | Hattori et al. | 123/90.11 |
| 6,431,474 | B2 | * | 8/2002 | Fochtman et al. | 239/585.4 |

* cited by examiner

*Primary Examiner*—Ramon M. Barrera
(74) *Attorney, Agent, or Firm*—Lahive & Cockfield, LLP

(57) ABSTRACT

An electromagnetic actuator has a core combined with a coil, and a movable member disposed so as to be attractable to an end face of the core, the movable member having an abutting surface for abutment against the end face of the core. The coil is selectively energized and de-energized to attract the movable member to and release the movable member from the end face of the core. The end face of the core is greater in size than the abutting surface of the movable member.

1 Claim, 2 Drawing Sheets

ELECTROMAGNETIC ACTUATOR

BACKGROUND OF THE INVENTION

1. Field of the Invention

The present invention relates to an electromagnetic actuator for attracting and releasing a movable member to and from a core by selectively energizing and deenergizing a coil.

2. Description of the Related Art

One known electromagnetic actuator is used in an actuating unit for a fuel injection valve that is mounted in a cylinder head for injecting fuel into a combustion chamber of an internal combustion engine.

The known electromagnetic actuator has an electromagnet comprising a coil wound around a bobbin and a core inserted in the bobbin and forming a magnetic path. The electromagnetic actuator also includes a movable member that has an outside diameter equal to the outside diameter of the core. When the coil is selectively energized and de-energized, the movable member can be attracted to and released from a distal end of the core for moving a valve body coupled to the movable body to inject fuel into the combustion chamber.

In order to achieve accurate fuel injection timing, it is desirable to increase the response of the movable member to attractive forces generated by the electromagnet. In addition, for injecting the fuel under a relatively high pressure to promote the atomization of the fuel, the high fuel pressure tends to develop a resistance to the opening and closing movement of the valve body, failing to make the movable body sufficiently responsive to the electromagnet's attractive forces. For this reason, the electromagnet is required to produce sufficiently large attractive forces.

The electromagnet can produce sufficiently large attractive forces if the core and the movable member are large in size. However, the core and the movable member that are large in size make it difficult to provide a necessary space in which to install the electromagnet on the internal combustion engine, and are unduly heavy. The heavy movable member is liable to make itself less responsive than desirable.

SUMMARY OF THE INVENTION

It is therefore an object of the present invention to provide an electromagnetic actuator which is capable of generating sufficient attractive forces, has a movable member highly responsive to generated attractive forces, and can be made compact.

To achieve the above object, there is provided in accordance with the present invention an electromagnetic actuator comprising a core combined with a coil, a movable member disposed so as to be attractable to an end face of the core, the movable member having an abutting surface for abutment against the end face of the core, and means for selectively energizing and de-energizing the coil to attract the movable member to and release the movable member from the end face of the core, the end face of the core being greater in size than the abutting surface of the movable member.

Since the end face of the core is greater in size than the abutting surface of the movable member, a sufficiently large magnetic path is provided to reduce a magnetic resistance for producing greater magnetic attractive forces for attracting the movable member. Because the abutting surface of the movable member is smaller in size than the end face of the core, the movable member can be reduced in size and weight for an increased response to attractive forces by which it is attracted to the core.

The end face of the core has an attracting surface for attracting the abutting surface of the movable member, and a tapered surface progressively reduced in diameter toward the attracting surface. The tapered surface of the end face of the core is effective to increase a flux density at the attracting surface for thereby concentrating the attractive forces on the abutting surface of the movable member. The movable member can thus reliably and quickly be attracted to the core for an increased response.

The tapered surface is preferably inclined from a line perpendicular to an axis of the core toward the axis of the core at an angle in the range from 40° to 60° or neighboring degrees. If the angle at which the tapered surface is inclined (hereinafter referred to as "taper angle") were 0°, then the tapered surface would not be formed and would blend flatwise into the attracting surface. If the taper angle were 90°, then the tapered surface would not be formed and the end face of the core would comprise the attracting surface only, so that the outside diameter of the core would be equal to the outside diameter of the movable member.

When the taper angle is smaller than 40°, the magnetic fluxes are led along the outer surface of the movable member and suffer an increased loss, resulting in a reduction in the flux density at the end face of the core, so that the attractive forces are reduced. When the taper angle is greater than 60°, the magnetic path of the core is narrowed and the magnetic resistance of the core is increased, resulting in a reduction in the flux density at the attracting surface of the core, so that the attractive forces are reduced. Sufficient attractive forces can be generated if the taper angle is in the range from 40° to 60°. Inasmuch as attractive forces are not sharply reduced even if the taper angle falls slightly out of the range from 40° to 60°, sufficiently high attractive forces can be produced if the taper angle is in the neighborhood of the range from 40° to 60°.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
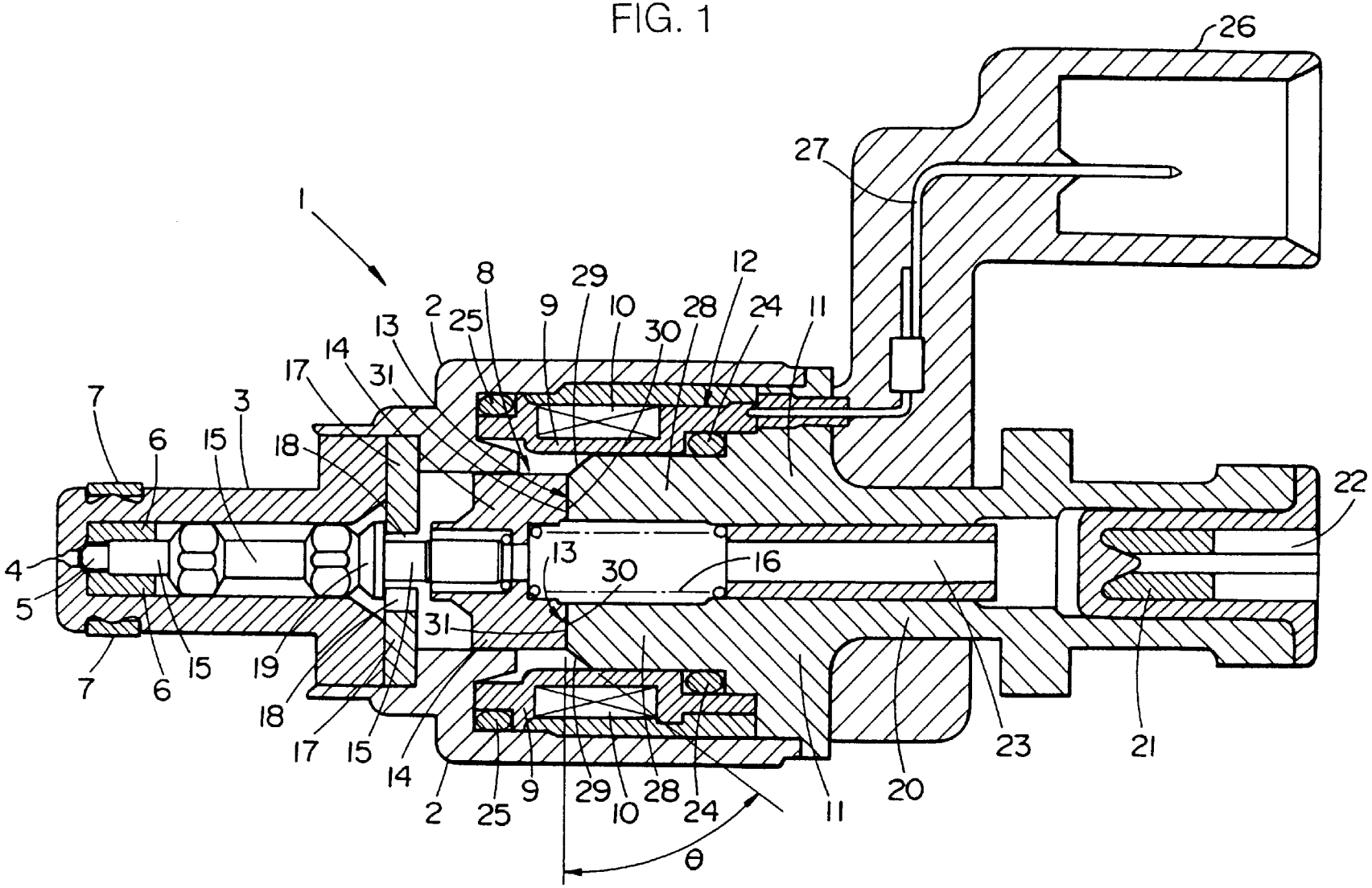
FIG. 1 is a cross-sectional view of a fuel injection device which incorporates an electromagnetic actuator according to the present invention.

FIG. 1 shows a fuel injection device 1 for use on an internal combustion engine (not shown). As shown in FIG. 1, the fuel injection device 1 comprises a substantially cylindrical housing 2 and a cylindrical connector 3 that is joined to a tip end of the housing 2 by staking or the like. The connector 3 has an injection port 4 defined in its tip end directed into a combustion chamber in the internal combustion engine for injecting fuel into the combustion chamber. The connector 3 houses therein a valve body 5 movable for selectively opening and closing the injection port 4. A swirl generator 6 is disposed around the valve body 5 in the connector 3 for imparting a swirling motion to the fuel as it is injected through the injection port 4. An annular thermally insulative seal 7 is disposed around the connector 3 near the injection port 4.

An electromagnetic actuator 8 according to the present invention is disposed in the housing 2. The electromagnetic actuator 8 has an electromagnet 12 comprising a coil 10 wound around and supported on a cylindrical bobbin 9 and a cylindrical core 11 coaxially inserted in the coil 10. The electromagnetic actuator 8 also has a movable body 14 made of a magnetic material or a soft magnetic material that can be attracted to an end face 13 of the core 11.

The movable member 14 is coupled to the valve body 5 by a rod 15. The movable member 14 is normally biased to move in a direction away from the core 11 by a helical spring 16 housed in the core 11. The rod 15 is axially movable through a partition wall 17 that is disposed between the housing 2 and the connector 3. A fuel path 18 is defined in a portion of the partition wall 17 and between the partition wall 17 and the rod 15. The rod 15 has a motion limiter 19 mounted thereon within the connector 3 for limiting movement of the rod 15 by abutting engagement with the partition wall 17.

The core 11 has a rear extension 20 extending continuously rearward away from the connector 3. A fuel supply 22 with a filter 21 is mounted in a rear end of the rear extension 20. Fuel supplied under pressure from the fuel supply 22 flows through a fuel conduit 23 axially inserted in the core 11 and a gap defined between an inner wall surface of the movable member 14 and the rod 15, and fills up a space defined in a front end of the housing 2 to which the connector 3 is joined. Seals 24, 25 are disposed between the core 11 and the bobbin 9 and between the bobbin 9 and an inner wall surface of the housing 2 for preventing the fuel filled under pressure from leaking out. A feeder connector 26 is attached to the housing 2 for supplying electric energy to the coil 10 via a conductor 27. An electric energy supply means (not shown) is connected to the feeder connector 26.

The core 11 has a magnetic path forming member 28 having an outside diameter greater than the outside diameter of the movable member 14 for producing sufficient magnetic fluxes to attract the movable member 14. The end face 13 of the core 11 includes a tapered surface 29 that is progressively reduced in diameter from the magnetic path forming member 28 toward the distal end of the core 11 and an attracting surface 31 extending from a distal edge of the tapered surface 29 and facing an abutting surface 30 of the movable member 14. Each of the attracting surface 31 and the abutting surface 30 comprises a flat surface lying perpendicularly to the axis of the core 11. The tapered surface 29 is inclined from a line perpendicular to the axis of the core 11 toward the axis of the core 11 at a taper angle θ that should preferably in the range from 40° to 60° or neighboring degrees. In the illustrated embodiment, the taper angle θ is set to 50°.

Figure 2:
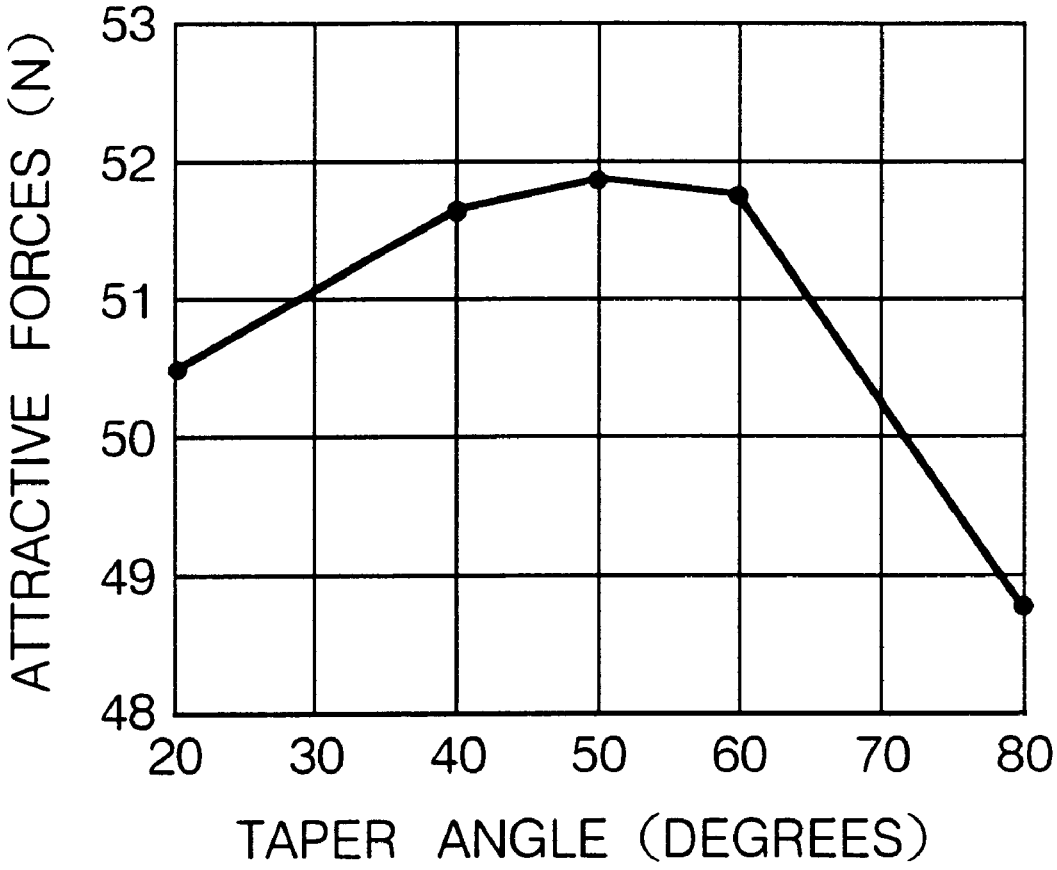
FIG. 2 is a diagram showing the relationship between the taper angle and the attractive forces of the electromagnetic actuator.

The above numerical values of the taper angle θ have been obtained by tests and simulations conducted to determine attractive forces for well attracting the movable member 14 to the core 11. Specifically, attractive forces produced by the electromagnet 12 to attract the movable member 14 to various cores having different taper angles θ, i.e., forces by which the abutting surface 30 of the movable member 14 is attracted to the attracting surfaces 31 of those various cores 11, were measured. As a result, as shown in FIG. 2, it has been found that the attractive forces are largest when the taper angle θ is 50° and are sufficiently large when the taper angle θ is 40° and 60°, and that the attractive forces are reduced the taper angle θ is 20° and greatly reduced the taper angle θ is 80°. Reasons for these different attractive forces are that when the taper angle θ is smaller than 40°, the magnetic fluxes are led along the outer surface of the movable member 14, resulting in a reduction in the flux density at the abutting surface 30 of the movable member 14, and when the taper angle θ is greater than 60°, the magnetic resistance of the core 11 is increased, resulting in a reduction in the flux density at the abutting surface 30 of the movable member 14. Consequently, it has been confirmed that sufficient attractive forces can be generated if the taper angle θ is in the range from 40° to 60° or neighboring degrees, and the taper angle θ is set to 50° in the illustrated embodiment.

Operation of the electromagnetic actuator 8 incorporated in the fuel injection device 1 will be described below with reference to FIG. 1. When the coil 10 is energized by the electric energy supplied from the feeder connector 26, the abutting surface 30 of the movable member 14 is attracted to the attracting surface 31 of the core 11, as shown in FIG. 1. The valve body 5 on the rod 15 connected to the movable member 14 is unseated to open the injection port 4, from which the fuel is injected into the combustion chamber.

When the coil 10 is de-energized, the movable member 14 is displaced away from the core 11 under the bias of the helical spring 16. The valve body 5 is seated to close the injection port 4, thus stopping the injection of the fuel into the combustion chamber.

Upon energization of the coil 10, the movable member 14 is displaced toward the core 11 under attractive forces generated by the electromagnet 12 until the abutting surface 30 of the movable member 14 is attracted to the attracting surface 31 of the core 11. Since the electromagnet 12 produces sufficiently large attractive forces because the taper angle θ is set to 50° as described above, the abutting surface 30 of the movable member 14 is reliably and quickly attracted to the attracting surface 31 of the core 11.

As the movable member 14 moves, the valve body 5 is displaced away from the injection port 4 by the rod 15, whereupon the fuel is injected under pressure from the connector 3 via injection port 4 into the combustion chamber.

In the above embodiment, the taper angle θ is most preferably set to 50° and preferably in the range from 40° to 60° or neighboring degrees. However, even if the tapered surface 29 is omitted, simply making the diameter of the magnetic path forming member 28 greater than the diameter of the movable member 14 to make the end face 13 of the core 11 greater than the abutting surface 30 of the movable member 14 is effective to produce greater attractive forces than if the abutting surface 30 of the movable member 14 and the end face 13 of the magnetic path forming member 28 of the core 11 were of the same diameter or shape as is the case with the conventional structure. Alternatively, the tapered surface 29 provided regardless of the magnitude of the taper angle θ is also effective to produce greater attractive forces.

Although a certain preferred embodiment of the present invention has been shown and described in detail, it should be understood that various changes and modifications may be made therein without departing from the scope of the appended claims.

What is claimed is:

1. An electromagnetic actuator disposed in a substantially cylindrical housing of a fuel injection device for use on an internal combustion engine, comprising:

a core combined with a coil wound around and supported on a cylindrical bobbin;

a movable member disposed so as to be attractable to an end face of said core, said movable member having an abutting surface for abutment against said end face of said core; and means for selectively energizing and de-energizing said coil to attract said movable member to and release said movable member from said end face of said core;

said end face of said core being greater in size then said abutting surface of said movable member, and having an attracting surface for attracting said abutting surface of said movable member, and a tapered surface progressively reduced in diameter toward said attracting surface from a side surface in intimate contact with an inner surface of said bobbin, wherein said tapered surface is inclined from a line perpendicular to an axis of said core toward the axis of said core at an angle in the range from about 40° to about 60°.

* * * * *